United States Patent [19]

Santi

[11] Patent Number: 5,014,605

[45] Date of Patent: May 14, 1991

[54] MAGNESIUM PISTON COATED WITH A FUEL INGITION PRODUCTS ADHESIVE

[75] Inventor: John D. Santi, West Allis, Wis.

[73] Assignee: Briggs & Stratton Corporation, Wauwatosa, Wis.

[21] Appl. No.: 482,841

[22] Filed: Feb. 21, 1990

[51] Int. Cl.[5] ..... F02F 3/00

[52] U.S. Cl. ..... 92/223; 123/193 P; 123/668

[58] Field of Search ..... 123/193 P, 668; 92/223, 92/212, 213, 222, 224; 164/20

[56] References Cited

U.S. PATENT DOCUMENTS

| | | | |
|---|---|---|---|
| 2,410,405 | 11/1946 | Cornelius | 92/223 |
| 2,926,649 | 3/1960 | Hicks | 92/223 |
| 3,935,797 | 2/1976 | Niimi et al. | 92/223 |
| 4,279,289 | 6/1981 | Ban et al. | 164/20 |
| 4,614,185 | 9/1986 | Fox | 123/668 |
| 4,694,813 | 9/1987 | Mielke | 92/223 |
| 4,706,616 | 11/1987 | Yoshimitsu | 123/41.84 |

*Primary Examiner*—Andrew M. Dolinar
*Assistant Examiner*—M. Macy
*Attorney, Agent, or Firm*—Andrus, Sceales, Starke & Sawall

[57] ABSTRACT

A fuel ignition products adhesive coating is disposed on the surface of an internal combustion engine piston. The coating protects the surface from corrosion and wear caused by the combustion of fuel in the cylinder.

4 Claims, 1 Drawing Sheet

MAGNESIUM PISTON COATED WITH A FUEL INGITION PRODUCTS ADHESIVE

BACKGROUND OF THE INVENTION

This invention relates to internal combustion engines, and more particularly to pistons used in such engines.

In two or four-cycle engines, such as the type used for lawn mowers and the like, magnesium may be used to make pistons when lightness of the piston is a major consideration. By using magnesium, the piston is approximately 30% lighter than a piston made from conventional materials. The lightness of magnesium causes less vibration in the two or four-cycle engine during operation. Lowering the vibration allows a more comfortable operation of an engine powered device.

The drawback to using magnesium in the piston is that the piston corrodes, erodes and sometimes burns. The moisture created in the combustion process tends to oxidize the magnesium and the heat generated tends to burn it.

SUMMARY OF THE INVENTION

In the present invention, the piston may be coated by a fuel ignition products adhesive coating so that the products of combustion will stick to the coated surface exposed to the combustion process. As the products from combustion come in contact with the fuel ignition products adhesive coating it is retained on the exposed surface until the entire exposed surface is coated with fuel ignition products.

The fuel ignition products become a protective coating covering the magnesium surface. The coating does not corrode, erode or burn like magnesium and will protect the magnesium piston without excessive build up of the coating.

In the preferred embodiment, iron phosphate is used as the fuel ignition products adhesive coating. It provides the necessary adhesion for retaining fuel ignition products and further provides a surface to which motor oil can adhere for necessary lubrication within the combustion chamber.

Only the portion of the piston which is exposed to fuel ignition in the combustion chamber may be coated to obtain favorable results. A dipping process may be used to coat either the entire piston or just the portion exposed to the ignition.

The piston is preferably dipped into a 1.3–2% solution of the adhesive coating. A single dip will provide the necessary thickness of coating.

The invention provides a solution to the problem of magnesium piston wear caused by the combustion process.

It is a feature and an advantage of the present invention to attract fuel ignition products to the adhesive coating surface which protects the piston surface from excessive wear, extending the life of the piston.

This and other features and advantages of the present invention will be apparent to those skilled in the art from the detailed description of the preferred embodiment and the drawings.

BRIEF DESCRIPTION OF THE DRAWING

The drawing illustrates the best mode presently contemplated for carrying out the invention.

In the drawing.

DETAILED DESCRIPTION OF THE INVENTION

Figure 1:
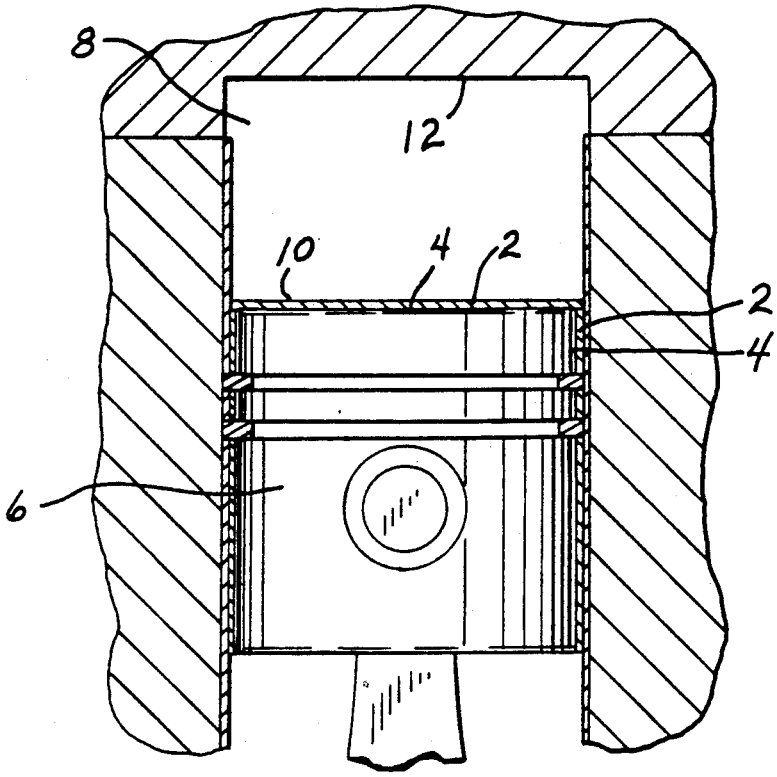
FIGS. 1 and 2 are side partial cross-sectional views of the invention inside an engine cylinder.

As seen in FIG. 1, a fuel ignition products adhesive coating 2 is located on surface 4 of piston 6.

Piston 6 reciprocates within combustion chamber 8. When the top portion 10 of piston 6 is near top portion 12 of combustion chamber 8, fuel is ignited and top portion 10 of the piston is exposed to the combustion.

Fuel ignition products adhesive coating 2 retains some or all of the combustion products and adhesion of the combustion products protects surface 4 of piston 6. Surface 4 is protected from adverse chemical reactions such as corrosion that is normally caused by the combustion process.

Figure 2:
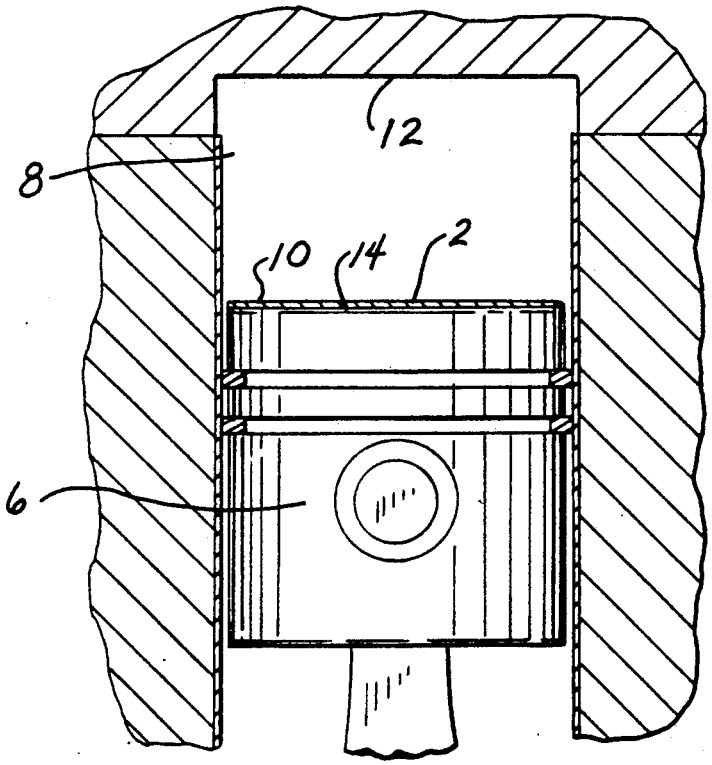

The fuel ignition products adhesive coating may be located on the entire surface 4 of piston 6 or only on top portion 14 (FIG. 2), exposed to the combustion. The preferred coating is composed of iron-phosphate, however chromate also may be utilized.

The coating may be located on the piston of any internal combustion engine, including the surface of a piston exposed to ignition in a rotary engine, to protect the piston from wear.

The adhesive coating is retained on the surface of a magnesium piston by a reaction between the magnesium and the iron phosphate. An ionic reaction occurs between the phosphate and the magnesium, causing them to combine, forming magnesium phosphate as the resulting compound. This coating will not react with fuel ignition products, therefore the products build up over the coated surface.

The phosphate coating is applied by dipping the piston to the desired height into a wash mixture of 2 to 3 ounces of iron phosphate per gallon of water wash mixture. Parker, Inc. and Dubois Corp. are suppliers of the concentrate.

The dipping procedure produces a coating of 1 monolayer of thickness. That small amount is sufficient to coat the surface and retain the fuel ignition products.

Various modes of carrying out the invention are contemplated as being within the scope of the following claims particularly pointing out and distinctly claiming the subject mater which is regarded as the invention.

I claim:

1. In an internal combustion engine of the type having at least one magnesium piston with a portion of a piston surface being exposed to fuel ignition products formed by fuel combustion in a combustion chamber, the improvement comprising:

an adhesive coating on said piston surface to which said fuel ignition products adhere during running of said engine, said fuel ignition products protecting said piston surface from adverse chemical reactions such as corrosion.

2. The improvement of claim 1, wherein said adhesive coating comprises iron phosphate.

3. The improvement of claim 1, wherein said adhesive coating comprises chromate.

4. The improvement of claim 1, wherein said adhesive coating is disposed only on the portion of the piston surface exposed to combustion.

* * * * *

UNITED STATES PATENT AND TRADEMARK OFFICE

CERTIFICATE OF CORRECTION

PATENT NO. : 5,014,605

DATED : May 14, 1991

INVENTOR(S) : John D. Santi

It is certified that error appears in the above-identified patent and that said Letters Patent is hereby corrected as shown below:

On the Title Page, Item [54]:

Delete "INGITION" and substitute therefore --- IGNITION ---

Signed and Sealed this

Twenty-first Day of June, 1994

*Attest:*

*Attesting Officer*

Bruce Lehman

BRUCE LEHMAN

*Commissioner of Patents and Trademarks*